United States Patent [19]

Paige

[11] 4,361,276

[45] Nov. 30, 1982

[54] HEATING SYSTEM HAVING SUPPLEMENTAL COIL ARRANGEMENT

[76] Inventor: Edward Paige, 2525 Fifth Ave., East Meadow, N.Y. 11554

[21] Appl. No.: 263,769

[22] Filed: May 14, 1981

[51] Int. Cl.[3] ..... F24D 3/00

[52] U.S. Cl. ..... 237/56; 237/8 R; 122/248; 122/18; 122/19

[58] Field of Search ..... 237/56, 8 R; 122/14, 122/18, 19, 247, 248; 110/234

[56] References Cited

U.S. PATENT DOCUMENTS 528,388 10/1894 Phillips ..... 122/247
761,719 6/1904 Side ..... 122/247

FOREIGN PATENT DOCUMENTS 15059 of 1901 United Kingdom .

*Primary Examiner*—William R. Cline
*Assistant Examiner*—John F. McNally
*Attorney, Agent, or Firm*—Goodman & Teitelbaum

[57] ABSTRACT

A heating system having a furnace with a lower combustion chamber for providing heat and an upper fluid heating chamber in which a fluid, such as water, is heated by the heat from the combustion chamber and passes through a supply pipe to heat an area. The cooled fluid returns to the fluid heating chamber through a return pipe. A serpentine coil arrangement is provided in the lower combustion chamber extending between the return and supply pipes for supplemental heating of at least a portion of the fluid directly within the combustion chamber. The serpentine coil arrangement is in a parallel flow relationship with the output from the fluid heating chamber.

1 Claim, 3 Drawing Figures

HEATING SYSTEM HAVING SUPPLEMENTAL COIL ARRANGEMENT

BACKGROUND OF THE INVENTION

This invention relates to heating systems and more particularly to a hot water or steam heating system which includes a supplemental heating coil arrangement.

There are numerous types of heating systems which are generally utilized for indoor heating of buildings. Some of the most common types include the steam heating and hot water heating systems. In both of these systems, a furnace is provided which includes a burner for burning a source of fuel. The fuel source can be gas, oil, or coal. The burner generates heat from the fuel, the heat being applied to an upper chamber in the furnace which contains water.

In the hot water system, the heat is used to heat up the water. Typically, a pump forces the hot water out of the water heater in the upper part of the furnace and through the pipes in the building to heat the various rooms.

A steam heating system works much like a hot water heating system, except that the water changes to steam in a boiler contained in the upper part of the furnace. The steam then passes through the pipes where it gives up its heat to the various rooms and becomes liquid again. The water then flows back into the boiler.

In both these types of systems, the furnace is constructed so that the lower part of the furnace is used to produce the heat by burning the fuel, and the upper part of the furnace is used as the water container where the water is heated or is boiled to form steam.

While both of these systems are commonly utilized, the efficiency of these systems is rather poor. It generally takes a large amount of fuel to generate sufficient heat to heat up or boil the water contained in the upper compartment of the furnace. This is especially a problem when starting up a furnace from a cold start, where it is necessary to heat up all the water to a sufficiently high temperature before any heat will be generated to the various rooms of the building.

At the same time, it has not been feasible to improve this efficiency since a separate compartment is required for the water and a separate compartment is required for the fuel combustion. The storage unit, whether it be in a hot water heater or in a steam boiler, must be securely sealed to prevent any water leaks. The burner section, on the other hand, requires a separate construction of heavy insulation and fire resistant surfaces to retain the heat. Also, it requires suitable air vents, smoke outlets, etc. As a result, two separate compartments have always been maintained to provide for the two separate requirements of these various units. Accordingly, although the two compartments are adjacent, nevertheless, they are separate, and accordingly the efficiency is low.

SUMMARY OF THE INVENTION

It is therefore an object of the present invention to provide a heating system which avoids the aforementioned problems of prior art systems.

A further object of the present invention is to provide a heating system which improves the efficiency of a steam heating or hot water heating unit.

Still another object of the present invention is to provide a heating system including a furnace having two separate compartments with a burner in one compartment for producing heat and a fluid compartment adjacent thereto for containing the fluid, and with a supplemental heating coil provided in the heat producing compartment for heating that portion of the fluid which passes through the heating coil.

A further object of the present invention is to provide a heating system having a continuous serpentine heating coil located in the combustion chamber of a furnace, to provide additional heat to the system by heating that portion of the fluid which passes through the heating coil.

Briefly, in accordance with the present invention, there is provided a heating system having a furnace with a combustion chamber and a fluid heating chamber. In the combustion chamber there is included a burner for burning fuel in order to produce heat. The fluid heating chamber stores a working fluid which is heated by the heat from the combustion chamber. A supply pipe is coupled to the fluid heating chamber for supplying the heated fluid to an area being heated. A return pipe is also coupled to the fluid heating chamber for returning the fluid, after it is cool, back to the fluid heating chamber for reheating. A tubular coil network in the combustion chamber is coupled between the supply and the return pipes for providing supplemental heating of the fluid within the system.

In an embodiment of the invention, the tubular network comprises two serpentine coil arrangements. One arrangement includes a continuous serpentine coil configuration which extends into a right angle so as to span two adjacent perpendicular side walls of the combustion chamber. This coil configuration commences at a lower level and weaves upward across the two adjacent side walls to an upper level where it extends out of the combustion chamber to join the supply pipe. The second continuous serpentine coil configuration includes one section which begins at a lower level adjacent a third wall of the combustion chamber and weaves upwardly to the top of the combustion chamber where it then turns at a right angle and continues from the back to the front adjacent an upper wall of the combustion chamber, and extends out of the combustion chamber to join the supply pipe. Both configurations are fed by the return pipe.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing like reference characters designate like parts.

DETAILED DESCRIPTION OF THE PREFERRED EMBODIMENT

Figure 1:
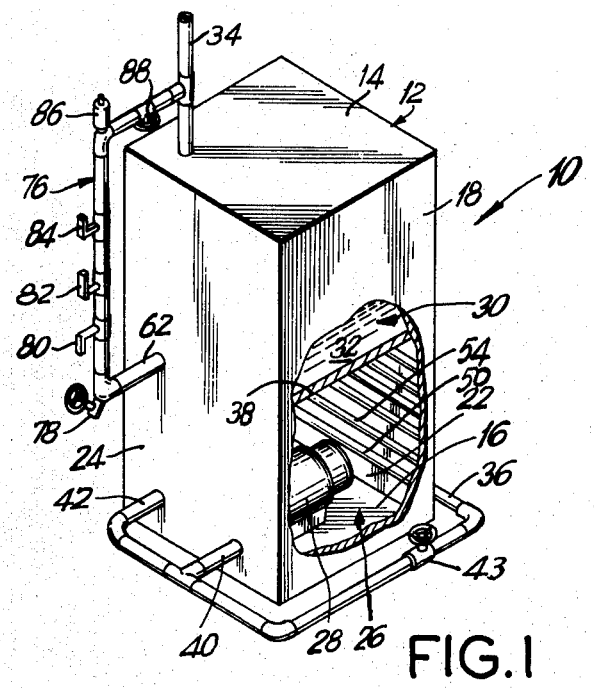
FIG. 1 is a perspective view, partially broken away, of the heating system in accordance with the present invention.

Referring now to FIG. 1, the heating system of the present invention is shown generally at 10 and includes a conventional furnace 12 of substantially rectangular configuration having a top wall 14, a bottom wall 16, front wall 18, rear wall 20, and side walls 22, and 24. The furnace is divided so as to include a conventional lower compartment 26 which serves as the combustion compartment or chamber. A conventional burner 28 is provided in the lower combustion chamber 26 and is available for burning various sources of fuels. The particular type of burning arrangement can be any of the well known arrangements, wherein a showing thereof is not thought necessary for an understanding of the present invention. The burner can burn gas, oil, or coal. Additionally, an electric heating unit can also be utilized. Normally, the lower combustion chamber 26 is empty and the walls about the combustion chamber are suitably insulated and protected to avoid escape of the heat, as is well known in the art. Bricks or other types of heat retaining materials, which are also fire resistant, are generally used around the combustion chamber.

Above the combustion chamber 26 is provided a storage compartment or fluid heating chamber 30 which stores the working fluid 32, typically water. In a hot water heating system, the water 32 is heated up and is then pumped out of the storage chamber 30 through a supply pipe 34 which passes into the various rooms in the building. The water pump (not shown) is located outside the furnace 12 and is a conventional type water pump. The supply pipe 34 can either connect to conventional convectors or radiant heat pipes, or other type of heat distributor, as is well known. The heat from the hot water is given up into the rooms to heat them. The water then returns to the hot water chamber 30 through a return pipe 36 in a conventional manner, wherein the connection of the return pipe 36 to the water chamber 30 is well known in the art and is not shown in order to more clearly show the present invention.

In a steam heating system, the operation is similar to that of the hot water heater except that the upper compartment 30 would be a steam boiler. The water is kept in the container until it changes into steam and then the steam passes through the supply pipe 34 to the convectors in the rooms, wherein no pumping is required. The steam gives up its heat to the rooms being heated, and becomes liquid again. The liquid water then flows back to the boiler through the return pipe 36 in a conventional manner, as set forth above. The wall 38 separates the two compartments 26 and 30.

As is evident from the description, the furnace 12 has poor efficiency since much of the heat in the combustion chamber 26 is wasted and will not be entirely utilized for heating the water in the upper fluid heating chamber 30. Additionally, since a considerable amount of water must be stored in order to heat an entire building, it will take a long time to heat the entire supply of water 32 contained in the water container 30. This will especially be a problem when starting up the furnace when the water is cold. When the water in the upper chamber 30 is at a lower temperature, it takes a very long time until it is sufficiently heated to flow out of the supply pipe 34.

In order to improve efficiency and have a quicker start-up of the furnace 12, there is provided a coil pipe arrangement in the combustion chamber 26 which is connected between the return pipe 36 and the supply pipe 34, being in a parallel flow relationship with the storage chamber 30. As a result, some of the water returning in the return pipe 36 passes through this coil pipe arrangement and is heated directly within the lower combustion chamber 26. After such heating, the water or steam from the coil pipe arrangement then joins up with the water or steam from the upper heating chamber by feeding directly into the supply pipe 34. It will be appreciated, that the water which passes through the coil pipe arrangement in the combustion chamber will heat up very fast since it is directly within the combustion chamber 26 and is closer to the source of heat. This quickly heated water or steam will be available for immediate supply into the supply pipe 34. As a result, faster starts can be had for heating the room from a cold start. Also, this heated water or steam will improve efficiency since at least some of the water will be directly heated within the combustion chamber 26. In the case of the hot water heating system, the same water pump is used to circulate the heated water in the coil pipe arrangement.

Figure 2:
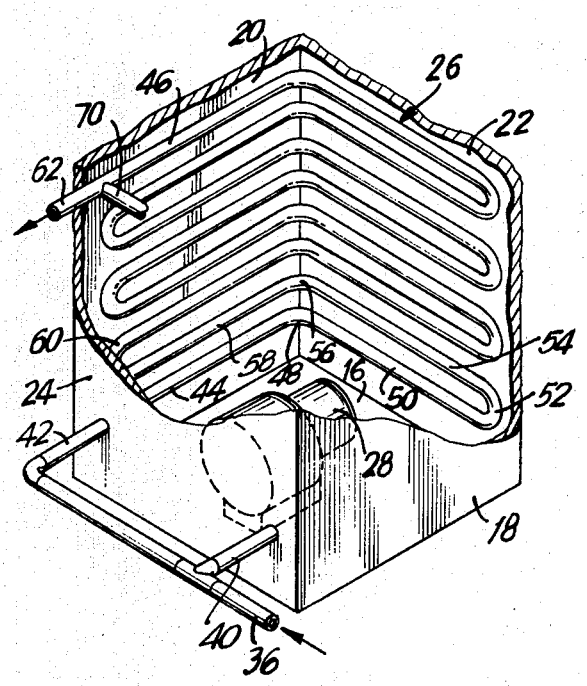
FIG. 2 is a perspective view, partially broken away, of the combustion chamber shown in FIG. 1, showing a first portion of the serpentine coil arrangement contained in the combustion chamber.
Figure 3:
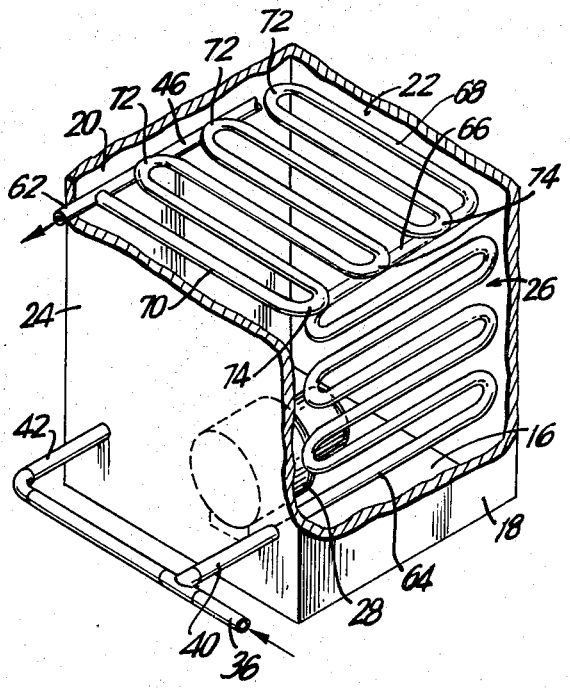
FIG. 3 is a perspective view, partially broken away, of the combustion chamber, showing a second portion of the serpentine coil arrangement contained in the combustion chamber.

As shown in FIGS. 1–3, the water returning through the return pipe 36, in addition to feeding the upper chamber 30 (not shown), also continues around the furnace so as to feed the coil pipe arrangement in the lower chamber 26 through the inlet conduits 40 and 42, wherein a conventional water gate 43 is provided in the line.

Referring now to FIG. 2, it will be noted that the inlet conduit 42 feeds a continuous serpentine coil arrangement which begins with a lower level pipe section 44 and weaves to an upper level pipe section 46. The pipe arrangement bends at its mid-point at a right angle so as to span across the adjacent perpendicular walls 20, 22.

More specifically, the pipe section 44 continues until proximate its mid-point 48 where it bends at a right angle and continues along into the lower level pipe section 50. It then makes a U-bend 52 adjacent the wall 22 and continues as the pipe section 54 until again it reaches its proximate mid-point at 56 where it then bends at a right angle and continues along into the pipe section 58 on the adjacent wall 20. Again it makes a U-bend 60 and then returns back. This coil arrangement continues in a serpentine configuration spanning the two adjacent walls 20, 22 until it reaches the upper pipe section 46 which feeds into the outlet section 62 which then feeds into the supply pipe 34 in a parallel flow relationship with the output from the upper chamber 30.

As shown in FIG. 3, the inlet conduit 40 feeds a second serpentine coil arrangement which is different from the one shown in FIG. 2. Particularly, the serpentine coil arrangement shown in FIG. 3 includes the lower pipe section 64 beginning at a low level and winding around in a serpentine coil arrangement adjacent the wall 18 until it reaches the upper level pipe section 66. It then bends into a right angle adjacent the wall 22 and continues into pipe section 68 along the wall 22. It then serpentines in a horizontal plane from the wall 22 forward to the wall 24 so as to lie adjacent the top wall 38 of the combustion chamber 26. The arrangement terminates in the pipe section 70 which feeds into the pipe section 62 to join the flow from the coil arrangement shown in FIG. 2, so as to also feed into the supply pipe 34.

It is therefore appreciated that in the lower combustion chamber 26, there are provided two parallel flow serpentine coils extending between the return pipe 36 and the supply pipe 34. One coil is fed from the inlet 42 and returns to the pipe section 62 through the pipe section 46. The other coil is fed from the inlet 40 and also returns to the pipe section 62 through the pipe section 70.

It should be appreciated, that the two parallel flow serpentine coils contained in the lower combustion chamber 26 are in fact in a parallel flow arrangement with the conventional fluid flow arrangement passing through the upper chamber 30. As a result, fluid returning from the building, where it gave up heat, passes through the return pipe 36 and simultaneously feeds, in parallel flow, the heating chamber 30 as well as the two parallel flow serpentine paths contained in the lower combustion chamber 26. The fluid passing through the two serpentine coils in the lower combustion chamber will heat up very fast and will immediately flow through the pipe section 62 back into the supply pipe 34 to be available for heating the rooms. The working fluid 32 in the upper heating chamber 30 will subsequently flow through the supply pipe 34 into the rooms.

As a result of this arrangement, when starting up from a cold start, hot water or steam will be immediately available as a result of the quick heating provided by the coils in the combustion chamber 26. Also, because the coils in the combustion chamber are in close contact with the source of heat, they will heat up faster and quicker and provide higher heating efficiency of the heating system.

Because of the unique serpentine arrangement, best use is made of the walls surrounding the combustion chamber. As shown in FIG. 2, one coil covers two adjacent side walls and, as shown in FIG. 3, another coil covers the third side wall and the top wall. The fourth wall is utilized for feeding of the fluid. Accordingly, maximum use is made of all of the walls for heating up the fluid. However, it should be understood that other arrangements could also be provided which would fall within the scope of the present invention.

As is shown in FIG. 3, by extending the distal U-shaped ends of the upper pipe sections, the upper pipe sections can actually be supported by the other pipes. Specifically, as shown, the U-shaped bends 72 at one distal end of the upper pipe sections overlie the pipe section 46 and are supported thereby. At the opposite distal end, the U-shaped bends 74 overlie the upper level pipe section 66 of the serpentine pipe arrangement adjacent wall 18 and are supported thereby. In this manner, support for the pipes can be had by means of the pipe arrangement itself and no additional suppport is required. The serpentine pipe arrangements on the walls can actually support themselves, or alternately can be connected to the side walls.

Additionally, for safety reasons and for convenience, the conduit 76 which connects the pipe section 62 to the supply pipe 34, as shown in FIG. 1, is provided with various devices well known in the art, such as a drain 78, a relief valve 80, a gauge 82, a pressure control 84, a vent 86 and a gate 88, wherein these are conventional devices and an explanation thereof is not thought necessary.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. In a heating system comprising a furnace having a combustion chamber provided with a burner therein for producing heat, said combustion chamber including top and bottom walls and four sidewalls with said burner disposed on said bottom wall, a fluid heating chamber in which a fluid is heated by said heat to define a boiler, supply pipe means coupled to said fluid heating chamber for supplying heated fluid for heating an area, and return pipe means coupled to said heating chamber for returning a cooled fluid to said fluid heating chamber, an improvement comprising:

a tubular network disposed in said combustion chamber around said burner;

means connecting said tubular network between said supply and said return pipe means for providing supplemental heating of a portion of the fluid within said tubular network, said tubular network providing a fluid flow for said portion of the fluid in a parallel flow relationship with the heated fluid flow through said fluid heating chamber;

said tubular network comprising a serpentine coil arrangement including first and second continuous serpentine coil configurations;

said first continuous serpentine coil configuration being provided with a right angle arrangement so as to span across two adjacent sidewalls of said combustion chamber, said first continuous serpentine coil configuration commencing at a low level and weaving upward across said adjacent sidewalls toward an upper level, said return pipe means being coupled to said first continuous serpentine coil configuration at said low level and said supply pipe means being coupled at said upper level;

said second continuous serpentine coil configuration having a first continuous serpentine coil section commencing at the low level and weaving across a third sidewall of said combustion chamber to the upper level, and a second continuous serpentine coil section integrally coupled to the upper level of said first continuous serpentine coil section and weaving across said top wall of said combustion chamber to interconnect to said supply pipe means, said low level of said first continuous serpentine coil section being coupled to said return pipe means;

said first and second continuous serpentine pipe configurations being in a parallel flow arrangement with each other between said return and said supply pipe means;

said second continuous serpentine coil section weaving from a back position to an opposing front position across said top wall; and opposing distal ends of said second continuous serpentine core section being respectively supported on the upper level of said first continuous serpentine coil section and a portion of the upper level of said first continuous serpentine coil configuration;

whereby said tubular network provides a quicker start-up of the furnace from a cold start, and also provides additional heat to the system.

* * * * *